US006572416B2

(12) United States Patent
Patwardhan et al.

(10) Patent No.: US 6,572,416 B2
(45) Date of Patent: Jun. 3, 2003

(54) THREE-PHASE CONNECTOR FOR ELECTRIC VEHICLE DRIVETRAIN

(75) Inventors: Ajay V Patwardhan, Inkster, MI (US); John Franklin, Ypsilanti, MI (US)

(73) Assignee: Ballard Power Systems Corporation, Dearborn, MI (US)

( * ) Notice: Subject to any disclaimer, the term of this patent is extended or adjusted under 35 U.S.C. 154(b) by 0 days.

(21) Appl. No.: 09/682,976

(22) Filed: Nov. 5, 2001

(65) Prior Publication Data

US 2003/0087560 A1 May 8, 2003

(51) Int. Cl.[7] ..... H01R 13/405
(52) U.S. Cl. ..... 439/736; 439/606
(58) Field of Search ..... 439/736, 181–187, 439/924.1, 685, 604, 606

(56) References Cited

U.S. PATENT DOCUMENTS

| | | | | | |
|---|---|---|---|---|---|
| 3,525,971 A | | 8/1970 | Glassman | 339/14 |
| 3,860,315 A | * | 1/1975 | Tetrault et al. | 439/186 |
| 4,229,061 A | | 10/1980 | Majors | 339/64 M |
| 4,420,202 A | | 12/1983 | Atakkaan | 339/14 R |
| 4,480,151 A | * | 10/1984 | Dozier | 174/153 R |
| 4,781,610 A | | 11/1988 | Mercer | 439/217 |
| 4,854,894 A | * | 8/1989 | Harrell | 439/606 |
| 5,053,918 A | | 10/1991 | Norden | 361/355 |
| 5,665,939 A | | 9/1997 | Jorgensen et al. | 174/50.52 |
| 5,952,613 A | | 9/1999 | Miettinen | 174/74 R |

* cited by examiner

*Primary Examiner*—Tho D. Ta
*Assistant Examiner*—Ross Gushi
(74) *Attorney, Agent, or Firm*—Seed IP Law Group PLLC

(57) ABSTRACT

A three-phase connector carries all three phases in one connector and keeps the phases properly isolated from each other and the motor case. The three-phase connector has metal connector components that are spaced from one another and supported in a nylon over molding covering each of the connector components, except for upper and lower exposed ends of the connector components, which are each drilled and tapped to receive bolts. First and second connector components extend above and below a flange of the three-phase connector with their respective exposed upper and lower ends offset in different planes than the exposed upper and lower ends of the third connector component.

14 Claims, 3 Drawing Sheets

THREE-PHASE CONNECTOR FOR ELECTRIC VEHICLE DRIVETRAIN

BACKGROUND OF INVENTION

1. Field of the Invention

The present invention relates generally to the field of electric machines, and more particularly to a three-phase connector for an electric vehicle drivetrain.

2. Background of the Invention

Phase connectors are connectors which carry current, for example, from the internally gated bipolar transistors (IGBT's) of an inverter to an electric motor. The IGBT is the power transistor in the inverter and generates the sine wave for the three-phase current. It is not possible to simply thread the wires for the three phases through an opening in the electric motor housing because the current carried through the phase connections is very high, such as 350–400 amps. In carrying the three-phase current from the IGBT of the inverter to a three-phase induction motor, the three phases must remain isolated, and it is necessary to have some kind of connector which isolates the phases from each other.

Previously, three separate connectors were used to carry the three-phase current to the electric motor. FIG. 1 shows a cross-sectional view of such a prior art separate phase connector 2. All three separate connectors were required to isolate the electric current from the motor housing as it passed through from the inverter. With separate phase connectors, each of the three individual connectors carries a separate phase current through a separate opening in the motor casing and is fastened with a separate set of fasteners. Thus, separate phase connectors require many different parts and must each be individually bolted to the housings with separate holes drilled for each connector. The resulting package was large, costly, and required significant effort to assemble.

SUMMARY OF INVENTION

It is a feature and advantage of the present invention to provide a three-phase connector that carries all three phases in one connector, while keeping all the phases properly isolated from each other and from the motor case.

To achieve the stated and additional features, advantages and objects, an embodiment of the present invention provides a three-phase connector that carries all three phases in one connector and keeps all the phases properly isolated from each other and the motor case. The three-phase connector has three separate metal inserts which act as each phase carrying electrical current to a three-phase induction motor. The three inserts are all molded into one plastic housing, which reduces the size and cost of the part, and reduces the effort required to assemble the drivetrain.

An embodiment of the present invention provides a three-phase connector, for example, for an electric vehicle drivetrain, utilizing two or more, and preferably three electrically conductive connector components, that are spaced from one another and supported in an over molding of electrically insulating material covering each of the connector components, except for upper and lower exposed ends of the connector components, and also forming a supporting flange. First and second ones of the connector components are spaced farther apart from one another than they are from a third connector component that is disposed, for example, between them. The first and second connector components extend above the flange with their respective exposed upper ends offset in different planes than the exposed upper end of the third connector component. The first and second connector components also extend below the flange with their respective exposed lower ends disposed in different planes than the third connector component.

In addition, the upper exposed ends of the first and second connector components are disposed a different and preferably shorter distance above the flange than the exposed upper end of the third connector component, and the respective lower exposed ends of the first and second connector components are disposed a different and preferably greater distance below the flange than the exposed lower end of the third connector component. Further, each of the connector components has an upper portion that extends a pre-defined distance above the flange and a lower portion that extends a greater distance below the flange than the pre-defined distance above the flange.

An electrically insulating material, such as nylon, is used for the over molding, and each connector component is made of an electrically conducting metal, such as tellurium copper, that is machined and over molded with the electrically insulating material. Each connector component is drilled at its upper and lower ends and tapped internally to receive a threaded bolt, for example, for a busbar or a lead. Each connector component has an exterior wall with one or more undercuts that provide an anchor for the over molding material. The flange is provided with openings to receive fasteners for attaching the flange to a housing. An alternate embodiment includes, for example, partitions formed by the over molding that extend upward from the flange between each of the first and second connector components and the third connector component.

Additional objects, advantages and novel features of the invention will be set forth in part in the description which follows, and in part will become more apparent to those skilled in the art upon examination of the following, or may be learned by practice of the invention.

DETAILED DESCRIPTION

Figure 2:
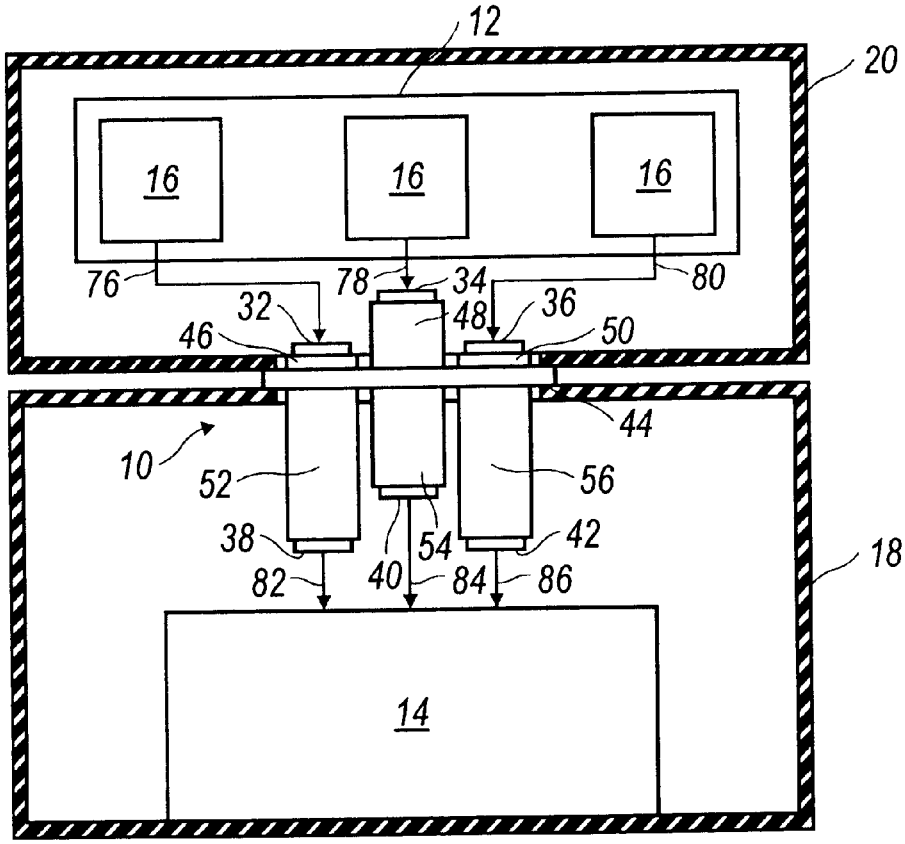
FIG. 2 shows a schematically arranged cut-away cross-sectional view of an inverter coupled to an electric motor by the three-phase connector for an embodiment of the present invention.

An embodiment of the present invention will now be described in detail with reference to the accompanying drawings wherein like reference numerals will be used to describe like components. Referring to FIG. 2, the three-phase connector 10 makes the connection between the inverter 12 and the electric motor 14. Disposed between the three IGBT's 16 of the inverter 12 and the three-phase connector 10 is a busbar (not more particularly shown), which connects the IGBT's 16 of the inverter 12 to the three-phase connector 10. The three-phase connector 10 sits on a casting 18, which is the housing for the electric motor 14, and the inverter 12 also has a housing or casting 20. The task of the three-phase connector 10 is to get the three-phase current through those two castings 18, 20 to the windings for the electric motor 14.

Figure 3:
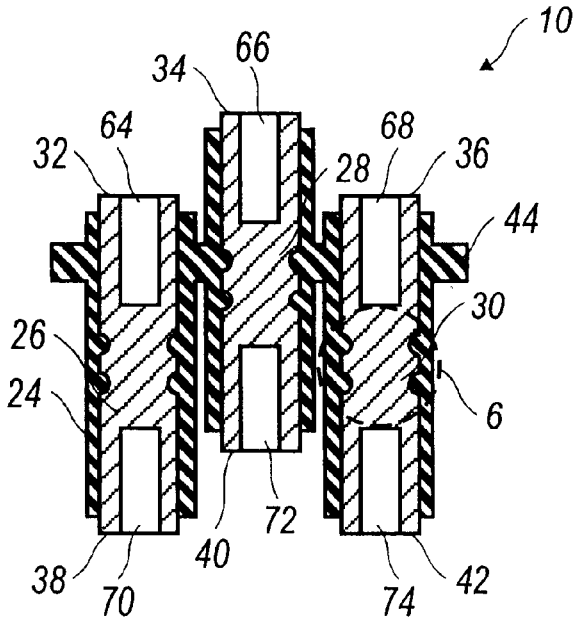
FIG. 3 is a cross-sectional view of the three-phase connector shown in FIG. 2 for an embodiment of the present invention.
Figure 4:
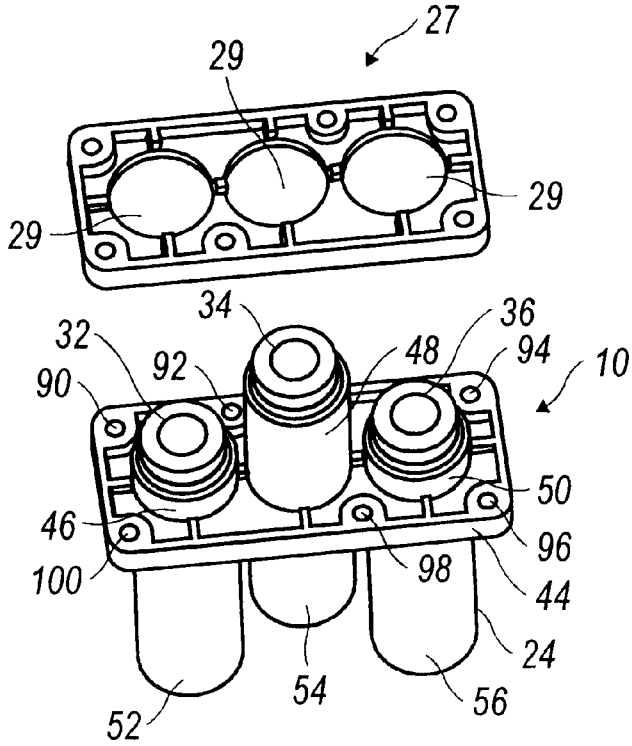
FIG. 4 is a perspective view of the three-phase connector shown in FIGS. 2 and 3 for an embodiment of the present invention.

Referring to FIGS. 2–4, the three phases are isolated at least in part with a nylon over molding 24 of the three-phase connector 10, which covers three metallic connector components 26, 28, 30, except for the upper exposed ends 32, 34, 36 and the lower exposed ends 38, 40, 42 of the three metallic connector components 26, 28, 30, and which also forms a supporting flange 44. When the three-phase connector 10 is installed, the connector components 26, 28, 30 are vertically oriented. In an automotive powertrain environment in which the three-phase connector 10 is used, it must be secured to hold it in place against vibration, and the three phases must be isolated from one another and from the housings.

Figure 1:
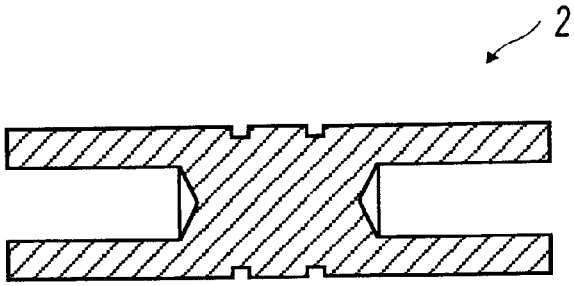
FIG. 1 ( PRIOR ART )
FIG. 1 shows a cross-sectional view of a prior art separate phase connector.

The three-phase connector 10 for an embodiment of the present invention replaces all the separate parts of the prior art separate connector 2 as shown in FIG. 1 and requires the drilling of only one opening in the housing 18, 20. Thus, the threephase connector 10 replaces the three prior art separate connectors with a single component 10 in the assembly, and only a single aperture is required to bolt the flange 44 of the three-phase connector 10 onto the casting 18. In addition, a seal or gasket (not more particularly shown) is provided beneath the flange 44 to seal the castings 18, 20 against intrusion, for example, of water, oil and other environmental contaminants.

Each connector component 26, 28, 30 of the three-phase connector 10 has an upper portion 46, 48, 50 which extends a pre-defined distance above the flange 44 and a lower portion 52, 54, 56 which extends a greater distance below the flange 44 than above the flange 44, and the lower portions 52, 54, 56 extend through the casing 18. The outer two connector components 26, 30 are offset relative to the center connector component 28. In other words, the two outer connector components 26, 30 extend in a different plane from, and a shorter distance above and greater distance below the flange 44, than the center connection component 28, to provide isolation between the three phases. The three phases must be isolated because they carry, for example, 300–400 amps, and isolation is provided between the fields at least in part by the air gap maintained between the connector components 26, 28, 30 disposed in different planes. Spacing the connector components 26, 28, 30 vertically in this way provides a greater air gap between the exposed metal at upper ends 32, 34, 36 and lower ends 38, 40, 42 of connector components 26, 28, 30 than would be provided simply by the horizontal distance between the connector components 26, 28, 30.

Figure 5:
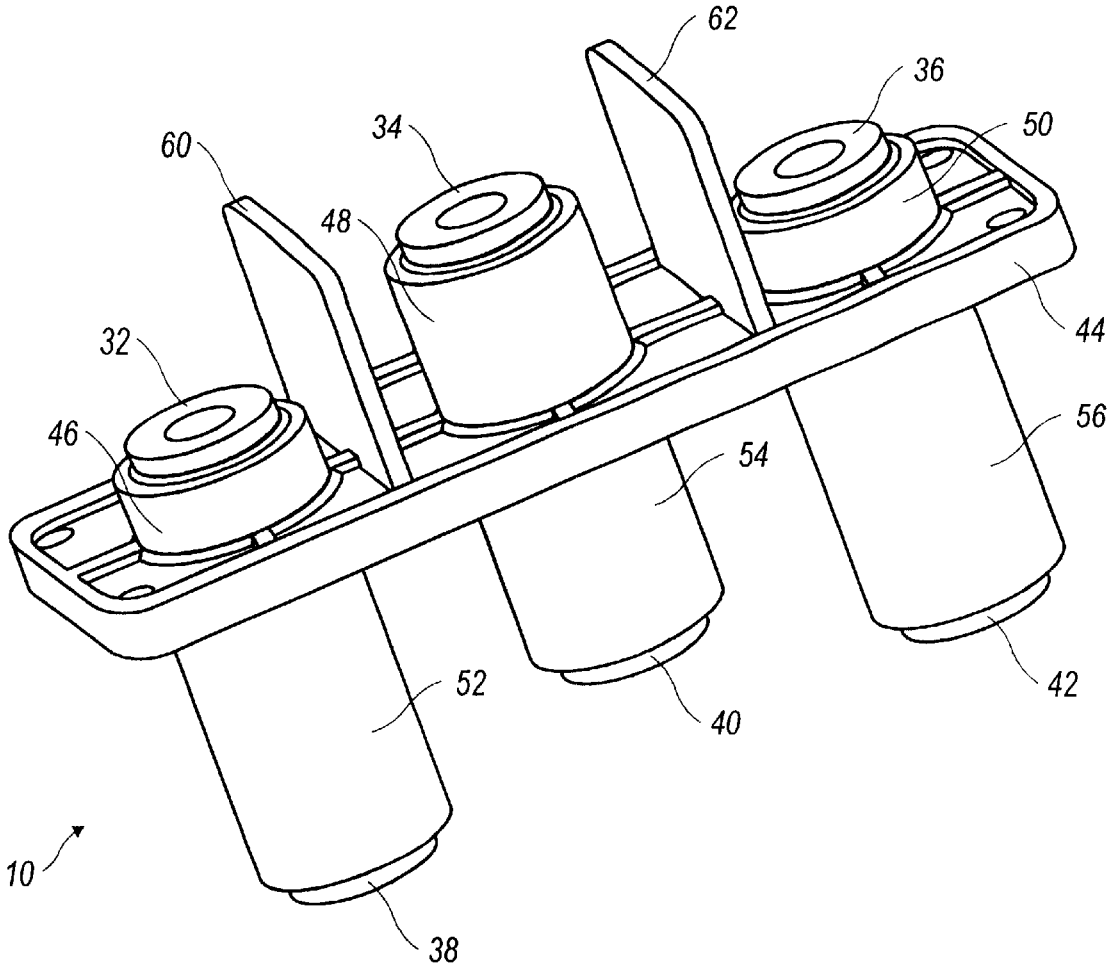
FIG. 5 is a perspective view of the three-phase connector with partitions for an alternate embodiment of the present invention.

FIG. 5 is a perspective view of a three-phase connector with partitions for an alternate embodiment of the present invention. In this alternate embodiment, isolation between the three phases is provided at least in part by partitions 60, 62, also formed by the over molding 24 of nylon, between the connector components 26, 28, 30. Thus, in the event greater isolation is required between the connector components 26, 28, 30 disposed in different planes, or if design considerations require that the connector components 26, 28, 30 be disposed in or closer to the same plane, the isolation can be provided at least in part by the partitions 60, 62.

Referring again to FIGS. 2–4, the connector components 26, 28, 30 of a three-phase connector 10 an embodiment of the present invention are made of metal that is machined and over molded with an electrical insulating material, such as nylon. Thus, each of the metal connector components 26, 28, 30 forms the core of a cylindrical over molding 24 of nylon with an exposed upper end 32, 34, 36 and an exposed lower end 38, 40, 42, which extends beyond the nylon over molded portion of each metal connector component 26, 28, 30. Each metal connector component 26, 28, 30 is drilled and tapped internally for a threaded fastener at its upper end 64, 66, 68 and lower end 70, 72, 74.

The tapped upper ends 64, 66, 68 of the metal connector components 26, 28, 30 extending above the flange 44 of the three-phase connector 10 are threaded to receive the threaded bolts of a busbar, such as a rigid busbar, shown schematically by arrows 76, 78, 80 in FIG. 2, in a separate busbar plane for each of the three phases. The tapped lower ends 70, 72, 74 of the metal connector components 26, 28, 30 extending below the flange 44 are threaded to receive the threaded bolts of leads, such as flexible wire leads, shown schematically by arrows 82, 84, 86 in FIG. 2, from the electric motor 14.

Referring further to FIG. 4, the flange 44 of the three-phase connector 10 for an embodiment of the present invention is provided with openings 90–100 to receive fasteners, such as fastening bolts (not more particularly shown), for attaching the three-phase connector 10, for example, to the electronics housing 20. In addition, a seal or gasket 27 (illustrated as flipped over to reveal the side which is adjacent the flange 44 when in use) on the bottom surface of the flange 44 provides. a seal between the two housings 18, 20. The seal or gasket 27 is disposed beneath the flange 44 and is generally the same shape as the flange 44, with openings 29 through which the bottom portions 52, 54, 56 of the connector components 26, 28, 30 extend and additional openings corresponding to the fastener openings 90–100 for the fasteners to extend.

Previously, three separate prior art individual connectors, such as individual connector 2 shown in FIG. 1, were used to carry the three phases of current from the inverter 12 to the electric motor 14. They were entirely separate parts and were not physically connected to one another in any way. It was necessary to fasten each separate connector individually to the electronics housing 20 with its own fasteners and its own seal or gasket. The three-phase connector 10 for an embodiment of the present invention eliminates the redundant fasteners and gaskets and combines the entire functionality into one component.

Figure 6:
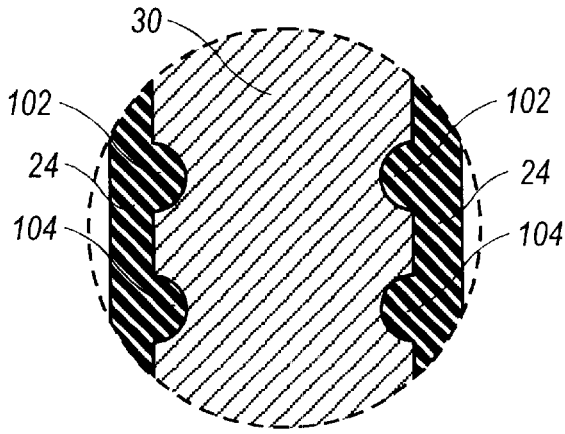
FIG. 6 is an enlarged partial view of a portion of one of the connector components shown in FIG. 3 illustrating an example of undercuts provided in each connector component for an embodiment of the present invention.

In an embodiment of the present invention, the nylon over molding 24 serves as insulation as well as to provide structural integrity of the three-phase connector 10. The metal connector components 26, 28, 30 of the three-phase connector 10 are made of a highly electrically conductive metal, such as tellurium copper, which is in the range of ninety-five percent copper. FIG. 6 is an enlarged partial view of a portion of one of the connector components 30 shown in FIG. 3. Referring to FIG. 6, the exterior wall of each metal connector component 26, 28, 30 includes one or more undercuts 102, 104 for proper sealing. The undercuts 102, 104 provide an anchor for the nylon over molding 24 and form a friction interface between the nylon over molding 24 and the exterior wall of each metal connector component 26, 28, 30.

The undercuts 102,104 are provided in the exterior wall of each metal connector component 26, 28, 30 because it has been found that a smooth exterior wall forms a relatively poor seal between the exterior wall and the nylon over molding 24 thereby allowing an unacceptable degree of leakage between the exterior walls of the metal connector components 26, 28, 30 and the nylon over molding 24. When the nylon absorbs moisture, it tends to expand away from the smooth exterior wall of the metal connector components 26, 28, 30. However, when the nylon over molding 24 disposed in the undercuts 102–104 in the exterior wall of the connector components 26, 28, 30 absorbs moisture and expands, it actually seals itself to the exterior walls of the connector components 26, 28, 30. The undercuts 102–104 in the exterior wall of the connector components 26, 28, 30 provide, for example, additional profiles for the nylon over molding 24 and create a better seal between the exterior walls of the connector components 26, 28, 30 and the nylon over molding 24.

Referring again to FIG. 2, it is important that the seal between the nylon over molding 24 and the exterior walls of the connector components 26, 28, 30 creates a vapor barrier between the upper and lower housings 20, 18. For example, the electric motor housing 18 can contain air with oil mist in it that must be kept out of the electronics. In some cases, the three-phase connector 10 may be used as an exterior connector to the environment, in which case there may be rain or water mist that must likewise be kept out of the electronics. In addition, the gasket beneath the flange 44 of the three-phase connector 10 seals the three-phase connector 10 to the cast housing 18, 20 and prevents moisture from passing between the housings 18, 20.

Various preferred embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the present invention.

What is claimed is:

1. A three-phase connector for an electric vehicle drivetrain, comprising:

a plurality of electrically conductive connector components spaced from one another, each of the connector components to electrically couple a respective phase of a three-phase power wherein each connector component has exposed upper and lower ends that are tapped internally to receive a threaded bolt for at least one of an inverter busbar and an electric motor lead;

an over molding of electrically insulating material covering each of the connector components, except for the exposed upper and lower ends of the connector components, and also forming a supporting flange; and wherein a first and a second of one of the connector components are spaced farther from one another than from a third one of the connector components, the first and the second connector components extending above the flange with their respective exposed upper ends offset in different planes from the exposed upper end of the third connector component, and the first and second connector components also extending below the flange with their respective exposed lower ends disposed in different planes from the exposed lower end of the third connector component.

2. The three-phase connector of claim 1, wherein the respective upper exposed ends of the first and second connector components are disposed a shorter distance above the flange than a distance that the exposed upper end of the third connector component is disposed above the flange, and the respective lower exposed ends of the first and second connector components are disposed a greater distance below the flange than a distance that the exposed lower end of the third connector component is disposed below the flange.

3. The three-phase connector of claim 1, wherein each of the connector components further comprises an upper portion that extends a pre-defined distance above the flange and a lower portion that extends a greater distance below the flange than the pre-defined distance above the flange.

4. The three-phase connector of claim 1, wherein the over molding of electrically insulating material further comprises a nylon over molding.

5. The three-phase connector of claim 1, wherein each connector component is made of tellurium copper.

6. The three-phase connector of claim 1, wherein each connector component has an exterior wall with at least one undercut providing an anchor for the over molding.

7. A three-phase connector for an electric vehicle drivetrain, comprising:

a plurality of electrically conductive connector components spaced from one another; and an over molding of electrically insulating material covering each of the connector components, except for exposed upper and lower ends of the connector components, and also forming a supporting flange;

wherein a first and a second of the connector components are spaced farther from one another than from a third connector component, the first and second connector components extend above the flange with their respective exposed upper ends offset in different planes from the exposed upper end of the third connector component, and the first and second connector components also extend below the flange with their respective exposed lower ends disposed in different planes from the third connector component, and wherein the flange is provided with openings to receive fasteners for attaching the flange to a housing.

8. The three-phase connector of claim 7, further comprising a partition formed by the over molding that extends upward from the flange between each of the first and second connector components and the third connector component.

9. A poly-phase connector to interconnect a poly-phase electrical bus and a poly-phase machine, the poly-phase connector comprising:

an electrically insulating body having a first side and a second side; and a number of spaced electrically conductive connector components, each of the connector components having a first end and a second end, the first and second ends of each of the connector components couplable to a respective phase of the poly-phase electrical bus and a respective phase of the poly-phase machine, wherein each of the connector components is at least partially received in the electrically insulating body such that at least the first ends of each of the connector components are exposed, at least one of the first ends terminating in a plane different from a plane in which at least one of the other first ends terminates, and wherein each of the connector components includes a threaded female receptacle in each of the first and the second ends thereof.

10. The poly-phase connector of claim 9 wherein the electrically insulating body forms a flange spaced between the first and the second ends of the connector components.

11. The poly-phase connector of claim 9 wherein the first and second sides are opposed.

12. The poly-phase connector of claim 9 wherein a first and a second one of the connector components are spaced farther from one another than from a third one of the connector components.

13. The poly-phase connector of claim 9 wherein the first end of each of the connector components extends from the electrically insulating body.

14. A poly-phase connector to interconnect a poly-phase electrical bus and a poly-phase machine, the poly-phase connector comprising:

an electrically insulating body having a first side and a second side;

a number of spaced electrically conductive connector components, each of the connector components having a first end and a second end, the first and second ends of each of the connector components couplable to a respective phase of the poly-phase electrical bus and a respective phase of the poly-phase machine, wherein each of the connector components is at least partially received in the electrically insulating body such that at least the first ends of each of the connector components are exposed, at least one of the first ends terminating in a plane different from a plane in which at least one of the other first ends terminates, wherein the electrically insulating body forms a flange spaced between the first and the second ends of the connector components; and a gasket adjacent and conforming to one of the first and the second sides.

* * * * *